United States Patent [19]

Weiner et al.

[11] 4,280,184

[45] Jul. 21, 1981

[54] BURNER FLAME DETECTION

[75] Inventors: Nathan K. Weiner, Stoughton; Peter J. Weyman, Boston; David D. Ketchum, Ipswich, all of Mass.

[73] Assignee: Electronic Corporation of America, Cambridge, Mass.

[21] Appl. No.: 52,113

[22] Filed: Jun. 26, 1979

[51] Int. Cl.[3] ..... G06F 15/20; G08B 17/12

[52] U.S. Cl. ..... 364/506; 250/554; 340/578; 328/6

[58] Field of Search ..... 364/506, 524, 527, 569; 250/554, 372; 340/577, 578; 431/24, 25, 75, 78, 79, 13; 328/1, 6; 356/315

[56] References Cited

U.S. PATENT DOCUMENTS

| | | | |
|---|---|---|---|
| 3,196,273 | 7/1965 | Abromaitis | 250/554 |
| 3,283,154 | 11/1966 | Giuffrida et al. | 250/554 |
| 3,416,041 | 12/1968 | Giuffrida et al. | 328/6 X |
| 3,651,327 | 3/1972 | Thomson | 250/554 |
| 3,936,648 | 2/1976 | Cormault et al. | 340/578 X |
| 3,958,126 | 5/1976 | Bryant | 250/554 |
| 3,967,255 | 6/1976 | Oliver et al. | 340/578 X |
| 3,995,221 | 11/1976 | MacDonald | 340/578 X |
| 4,157,506 | 6/1979 | Spencer | 340/577 X |

FOREIGN PATENT DOCUMENTS

| | | | |
|---|---|---|---|
| 1456466 | 11/1976 | United Kingdom | 431/24 |

*Primary Examiner*—Joseph F. Ruggiero
*Attorney, Agent, or Firm*—Charles E. Pfund

[57] ABSTRACT

Method and apparatus for evaluating the quality of a flame in response to outputs from a flame sensor.

The present invention includes a method and apparatus in which output pulses from a flame sensor are continuously counted.The number of pulses is accumulated over a time interval of a predetermined length and compared with a threshold value. The accumulated total is continuously updated to reflect the pulses received over the previous time interval to effectively provide a moving time-window of a fixed length over which pulses from the flame sensor are accumulated. Other additional checks may be made to ascertain that a flame is present, including the time over which no pulses are detected and a long-term average of the number of pulses.

A preferred embodiment disclosed in which numerous self-checking features are incorporated, and which includes a novel bar-graph type of display for displaying flame quality and diagnostic information.

37 Claims, 7 Drawing Figures

BURNER FLAME DETECTION

FIELD OF THE INVENTION

The present invention is related to furnace and burner systems, and more particularly to circuitry for determining the presence of a flame in a burner in response to output signals from a flame scanner tube or the like.

BACKGROUND OF THE INVENTION

In furnaces and other systems including burners for producing a flame, it is frequently desirable or necessary to monitor the burner to ascertain that a flame is, in fact, present during times when the burner is operating. Accordingly, devices have been developed for monitoring a flame and providing an output signal representative of whether or not a flame is present in the burner. Such devices find particular application in furnace systems where it is necessary to continuously monitor a flame to ensure safe operation.

For example, it sometimes happens that upon starting up a furnace, the burner does not ignite. Another occurrence which is not uncommon is a flame-out where a burner flame is extinguished during the operation of the burner. Such situations may be extremely dangerous if not promptly detected. Typically, burner control systems monitor the presence of a flame, and upon a loss of flame, the burner control system immediately shuts off the fuel supply to the burner. If such precautions are not taken, a dangerous concentration of unburned fuel and/or vapors may accumulate in the furnace and result in a fire or explosion.

Various devices and circuits have been known in the prior art for monitoring the presence of a flame. Typically, such devices include a sensor, such as an ultraviolet or infrared radiation sensor, which provides an output signal in response to radiation from a flame. The output signal from such a sensor is applied to a flame analyzer circuit which processes the signal and provides an output signal representative of whether a flame is present.

Typically, the flame sensor output signal is composed of a series of pulses. These pulses must be filtered to smooth them out and to provide a continuous signal representative of the flame quality. For safe operation, such filters must have a response time sufficiently rapid that the circuit output signal indicates a no-flame condition within a predetermined short period of time after a loss of flame.

Prior art circuits for providing the above-described filtering have employed RC or equivalent circuits to which are applied the flame sensor output signals. By choosing the proper parameters and time constants for the RC circuit, individual pulses from a flame may be smoothed out while still providing a response time rapid enough to prevent the build-up of an unsafe condition after a loss of flame.

Due to the highly critical nature of the flame detector circuitry, it is very important that such circuitry be extremely reliable. In order to verify proper operation of the entire flame evaluation circuit, a flame sensor shutter is frequently employed to periodically shield the flame sensor from the flame being monitored. Additional circuitry is provided to ascertain that pulses are not produced by the flame sensor circuitry during the interval when the shutter is closed. Such circuits are shown in U.S. Pat. Nos. 2,798,213 and 2,798,214.

While prior art circuits for evaluating the quality of a flame have generally proved to be reliable in terms of avoiding malfunctions, under certain conditions, such circuits have difficulty in distinguishing between a flame of acceptable quality and one of unacceptable quality. In view of the extreme danger of an indication that a flame is present when no flame exists, such flame detection circuits are generally designed to err on the safe side. Under marginal flame conditions or when the flame sensor does not have a good line-of-sight view of the flame, this results in annoying shutdowns of the furnace system due to an erroneous decision that no flame is present.

A similar situation can exist with a multiple burner system. In such a system, it is important to monitor the flame from each burner and to shut down a burner if its flame goes out. Generally, individual flame sensors are used to monitor each burner and are adjusted to be exposed to direct radiation from that burner only, to as great an extent as possible. However, background radiation from other burners and signals produced by flames from other burners flowing into the line-of-sight of a flame sensor may result in output pulses from the flame sensor even though its burner has been extinguished. Here too, prior art flame detection circuitry frequently has difficulty distinguishing a no-flame condition. For safety, such circuits must again err on the safe side, resulting in nuisance shutdowns which are not necessary.

SUMMARY OF THE INVENTION

The present invention includes a novel method for evaluating the quality of a flame based on outputs from a flame sensor, such as an ultraviolet or infrared scanner tube. The present invention provides much higher discrimination between background radiation and an actual flame than do prior art devices. This results in fewer unnecessary shutdowns of a furnace system due to an erroneous decision that no flame is present. The present invention also provides good discrimination under marginal flame conditions. In flame situations which cause prior art flame detection circuits to repeatedly drop in and out for flames which are acceptable, although marginal, the present invention can determine a flame quality with much higher precision than can prior art circuits, again resulting in fewer unnecessary shutdowns of the furnace system.

Briefly, the present invention includes a method in which output pulses from a flame sensor are continuously counted. The number of pulses is accumulated over a time interval of a predetermined length and compared with a threshold value. The accumulated total is continuously updated to reflect the pulses received over the previous time interval to effectively provide a moving time-window of a fixed length over which pulses from the flame sensor are accumulated. The accumulated number of pulses is then compared with a threshold, and if it falls below that threshold for a predetermined time, the flame analyzer determines that the flame is unacceptable. In the preferred embodiment, two additional checks are made to ascertain that a flame is present. If no pulses are detected during the time-window interval, a no-flame output signal is immediately provided. Also, a long-term average of the number of pulses is periodically calculated, and a no-flame signal is provided if this average falls below the threshold.

A preferred embodiment for carrying out the method of the present invention is disclosed in which numerous self-checking features are incorporated to provide a flame quality analyzer which is much more fail-safe than prior art devices, in addition to providing a better determination of the flame quality. The preferred embodiment further is capable of providing diagnostic outputs to indicate the type of malfunction which has occurred when such a failure is detected and the burner system is shut down.

DESCRIPTION OF THE DRAWINGS

These and other advantages of the present invention will become more apparent upon reading the following description of the preferred embodiment in conjunction with the accompanying drawings of which.

DESCRIPTION OF THE PREFERRED EMBODIMENT

Figure 1:
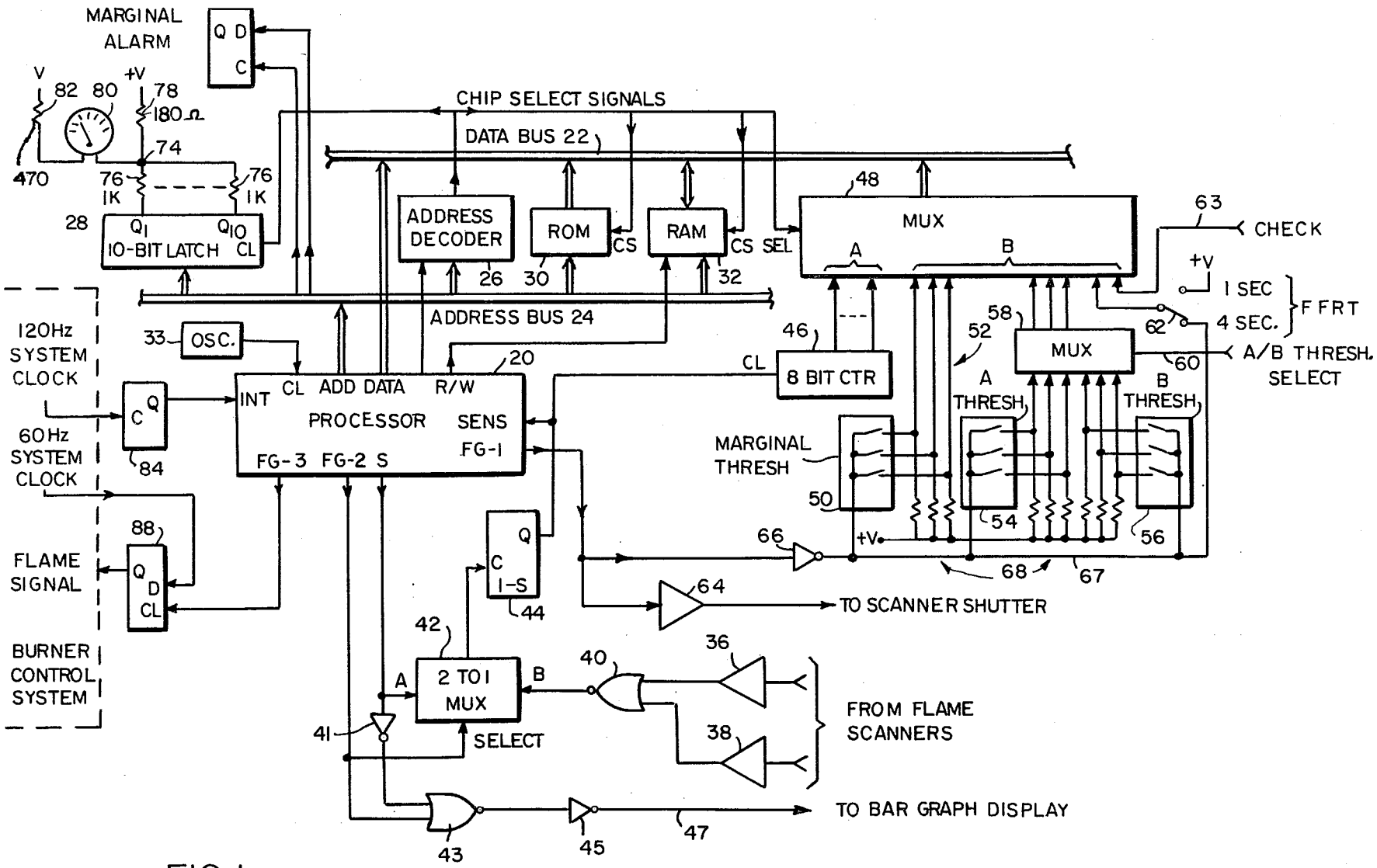
FIG. 1 shows one embodiment of the present invention.

Before describing the present invention, a discussion of prior art methods of evaluating a flame will be useful. As discussed above, most prior art flame analyzers have included filter circuits for filtering and smoothing pulses produced by a flame sensor. A typical filter would include, for example, 1 or 2 RC filter sections to which are applied pulses from the flame sensor. The filter output is a signal level representative of the flame quality detected by the flame sensor. This signal level is applied to a threshold detector or other similar circuitry which provides a flame-present or no-flame output indication.

A flame analyzer must respond to a loss-of-flame condition within a predetermined time so that the burner control circuitry responsive to the flame analyzer output signal may shut down the furnace system before a dangerous concentration of unburned fuel and/or fumes can accumulate. This time is generally known as the flame failure response time (FFRT). The FFRT is frequently imposed by governmental agencies responsive for furnace safety. For example, in the United States, the FFRT is generally 4 seconds while in Europe a 1 second FFRT has been generally adopted. The time constants and other parameters of the above-described filter circuitry are therefore chosen so that the flame analyzer output will respond to a loss of flame condition within the flame failure response time.

The above-described types of flame analyzer circuits have the advantages of simplicity, reliability, and economy. In some applications, however, the performance of such systems is compromised by necessary trade-offs in their design. As discussed above, the filter circuit time constant is constrained by the applicable flame failure response time. Due to the inherent instability of a flame, the rate at which pulses are produced by the flame sensor varies over a wide range about the average expected rate. In some burner systems, the burner configuration results in very low pulse rates being produced by the flame sensor. In these applications, a temporary decrease in the number of pulses per second produced by the flame sensor, which may be within the expected variation, can result in a no-flame indication from the flame analyzer. More filtering may be added to provide further smoothing of the flame sensor output pulses; but such filtering can not be allowed to result in a filter response time which exceeds the flame failure response time.

In multiple burner installations, a contrary problem may arise. In such installations, a flame sensor monitoring the flame from one of several burners is exposed both to direct radiation from the monitored burner and to background radiation from other burners in the furnace. In such systems, the flame analyzer must be able to distinguish pulses produced by an actual flame from pulses which may be produced by such background radiation.

The present invention includes a method for analyzing and evaluating pulses produced by the flame sensor to determine whether or not a flame is present. The present invention provides a flame analyzer whose performance is substantially improved over prior art types of flame analyzer circuits. In the present invention, pulses produced by a flame sensor monitoring a burner flame are processed in such a manner that any pulses occurring during the immediately preceding FFRT time interval are all counted with equal weight, while any pulses produced outside this interval are not counted and have zero weight. This is in contrast with the previously-described filter-type circuits which have been used by the prior art. In such filters, pulses produced by a flame sensor are non-linearly weighted, depending on when in time they occurred. For example, an RC type filter having an exponential response results in pulses which have occurred more recently being accorded more weight than pulses which have occurred longer ago. It has been discovered that this is undesirable and that the performance of a flame analyzer may be greatly improved by according equal weight to all pulses which have occurred during the previous FFRT interval.

Another disadvantage of filter-type circuits is that their response time extends beyond the flame failure response time. Thus, a pulse produced by a flame sensor more than one FFRT interval ago, although attenuated, still results in a finite output from the filter circuit. A flame analyzer should produce a no-flame output within the FFRT regardless of the presence of a flame prior to that time. A filter circuit whose output reflects pulses occurring prior to the FFRT interval is therefore influenced by events which should not be considered at all in determining whether or not a flame exists at the present time.

In the present invention, an interval, or "time-window" is defined, which is equal to the flame failure response time, and the number of pulses produced by the flame sensor during the time-window is counted. The time-window is moved in time by continuously updating the pulse total so that it reflects the total number of pulses produced by the flame sensor during only the previous FFRT interval. By comparing this total with a threshold value, the presence or absence of a flame is determined. In the embodiment described below, the FFRT and time-window are both 4 seconds long, and the time-window is advanced and a new pulse total is calculated every $\frac{1}{8}$ second.

With the present invention, every pulse occurring during the immediately-preceding FFRT interval is given equal weight in determining whether a flame is present. Additionally, any pulse occurring outside the time-window is completely disregarded in determining whether a flame is present. As a result, the present invention performs substantially better than prior art flame analyzers, especially in certain situations, such as multiple burner furnaces where a flame sensor is exposed to background radiation from other burners, and burner installations where the flame sensor produces pulses at a low pulse rate.

In addition to the basic flame evaluation method described above, the described embodiment uses several additional criteria in determining whether a flame is present. In addition to a pulse total accumulated over the preceding FFRT interval, the described embodiment calculates a long-term average number of pulses produced by the flame sensor over a preceding interval much longer than the FFRT period. In the present embodiment, this long-term average is accumulated over 32 seconds. If the average pulse rate over the previous 32 second interval falls below the selected threshold pulse rate at any time, the described embodiment determines that a loss of flame has occurred. Additionally, the described embodiment monitors the pulses received from the flame sensor, and if no pulses are received for an interval equal to the FFRT, the analyzer determines that a flame-out has occurred and a signal indicative of an absence of flame is immediately produced.

The described embodiment additionally requires that the number of pulses exceeds the selected threshold value by a predetermined factor in order to determine that the flame has been initiated, i.e., to go from a no-flame condition to a flame-present condition. This ensures that the flame signal will not oscillate between a no-flame and flame-present state during the period when the burner is being ignited. In the present embodiment, the total pulse number accumulated over the previous FFRT interval must exceed $2\frac{1}{2}$ times the threshold value before a flame-present condition is determined to exist.

Referring to FIG. 1, there is shown a block diagram of one circuit suitable for performing the previously described method for evaluating a flame sensor output signal. The circuitry shown in FIG. 1 includes a digital processor 20. The functions of processor 20 may be performed by many different types of digital data processing equipment, including microprocessor. Many microprocessors are commercially available which may be used in implementing the present invention, and the general principles associated with the implementation and operation of these microprocessors are well known to those in the art.

One microprocessor suitable for use with the present invention is the National Semiconductor mode SC/MP II microprocessor. This microprocessor is used in the preferred embodiment described herein. The SC/MP II microprocessor is well known and widely available, and extensive documentation of its structure and operation has been published. For this reason, the detailed operation and structure of processor 20 need not be further elaborated upon hereinbelow. Other digital processors and microprocessors may be suitable for use with the present invention, and the implementation of the present invention with a processor other than that described will be readily apparent to one of ordinary skill in the art from the description herein of the preferred embodiment. Accordingly, the description of a particular microprocessor in connection with the described embodiment is not to be construed as a limitation upon the invention.

Data is transferred to and from processor 20 along an 8-bit data bus 22. The circuitry from which or to which data is to be transferred is designated by signals applied by processor 20 to an address bus 24. In the described embodiment, address bus 24 has 12 lines representing 12-bits of address information; and the lower 4-bits of data bus 22 may also be used for address information during certain cycles. Signals from the 3 most significant bits of address bus 24 are applied to an address decoder 26 along with other signals directly from processor 20. In response, address decoder provides at its output several different chip select signals which designate which circuit should be enabled during each cycle of the processor.

Address decoder 26 also provides two clock signals in a similar manner which are used to clock a 10-bit latch circuit 28 and a flip-flop 29 which provides a marginal alarm signal.

Ten bits of address information from address bus 24 are applied to the inputs of latch circuit 28, and the clock signal from decoder 26 is used to clock this data into the latch circuit. Latch circuit 28 provides an analog signal in conjunction with resistors 76, 78, and 82 for driving a meter to provide a readout of the flame quality, as described in detail below. By transferring the information to latch circuit 28 on address bus 24, the entire 10 bits may be transferred in one operation. If this data were transferred by means of 8-bit data bus 22, two microprocessor cycles would be required to transfer the entire 10-bits.

The address data on address bus 24 is also applied to the address inputs of a read-only memory (ROM) 30 and a random access memory (RAM) 32. ROM 30 contains program data in response to which processor 20 performs the desired operations to properly control the remainder of the flame analyzer circuitry. When data is to be read from ROM 30, the address decoder 26 provides a chip select signal to ROM 30, and in response to the address on address bus 24, ROM 30 applies the appropriate data to data bus 22 from which it is read by processor 20. In the presently described embodiment, ROM 30 contains approximately 2 K 8-bit words. One example of the contents of a ROM suitable for use with the present invention is given in the program listing included as Appendix A to this application, which is part of the file history of this patent.

RAM 32 provides a memory in which data may be temporarily stored and retrieved by processor 20. Similarly to ROM 30, RAM 32 is addressed by the appropriate chip select signal from decoder 26 and address data on address bus 24. A read/write signal from processor 20 is also applied to RAM 32 to indicate whether data is to be read from or written into the RAM. Also associated with processor 20 are other circuits which are necessary for the proper operation of the microprocessors and which are well known to those in the art, including power supply circuitry, a clock oscillator 33, and power-up reset circuitry. In view of its well known nature, this circuitry is not shown in FIG. 1 for the sake of clarity.

The signal from the furnace flame scanners is received by processor 20 in the following manner. The signal from a flame scanner is applied to a flame scanner amplifier 36, which includes circuitry for filtering the output signal from the flame scanner, for amplifying this signal and for converting this signal to a digital level. If desired, a second flame scanner may be used; and in this case, the signal from the second flame scanner would be applied to a second flame signal amplifier 38. The output signals from amplifier 36 and 38 are applied to a NOR gate 40 which combines these two signals. The output from NOR gate 40 goes low in response to a pulse from either flame scanner.

The output from NOR gate 40 is normally applied by a multiplexer 42 to a one-shot 44. The function of multiplexer 42 is described below. In response to a pulse from one of the flame scanners, one-shot 44 is clocked, and the output from the one-shot goes high for a predetermined period of time. In the presently described embodiment, the period of one-shot 44 is approximately 120 microseconds; and one-shot 44 is preferably of a non-retriggerable type.

By using the output pulse from the flame scanners to trigger a one-shot, the effects of variations in the widths of the pulses from the flame scanners are reduced or eliminated. This is in contrast with a conventional filter type of circuit. For example, in a typical RC filter circuit, a pulse which is twice as long as another pulse causes the RC circuit to change for a longer period of time. The result is that a longer pulse is more heavily weighted in the final average than a shorter pulse. Since both long and short pulses from the flame scanners are generally produced by a single flame "flicker", the only difference being the length of the "flicker", this unequal weighting is undesirable.

In response to a pulse from one of the flame scanners, one-shot 44 produces a pulse at its output. This pulse is applied to the clock input of an 8-bit counter 46, and is also applied to the "sense" input of processor 20 for reasons described below. Thus, counter 46 is incremented in response to pulses from the flame scanners. The 8 outputs from counter 46 are applied to the inputs of an 8-bit, 2-to-1 multiplexer 48, and the value in counter 46 is periodically read by processor 20. To read the value in counter 46, processor 20 applied signals to address decoder 26 which applies enable and select inputs to multiplexer 48 which selects the inputs from counter 46, and applies these signals to data bus 22 where they are read by processor 20.

The second set of 8 inputs to multiplexer 48 includes the following signals. Three sets of 3 switches are used to select the threshold which the processor uses in determining the flame quality. A marginal threshold switch 50 selects one of several values for a marginal threshold. The value selected is applied to multiplexer 48 on lines 52. Two additional sets of 3 switches 54 and 56 select 2 threshold values, denominated as "A" and "B" thresholds. The A and B thresholds are independently selectable from among one of 8 values each. The 3 lines from each of switches 54 and 56 are applied to another 2-to-1 multiplexer 58.

An A/B select input on a line 60 is applied to multiplexer 58 and determines which threshold value selected by multiplexer 58. The A/B threshold select signal is typically supplied by the burner control system. Some systems will use only a single threshold, in which case the A/B threshold select option is not used. In other installations, a different threshold value may be used, for example, for determining the flame quality of the pilot flame and the main burner flame. In such a system, the burner control system would apply the appropriate signal on line 60 to select the proper threshold during different periods of the furnace operation.

The A and B threshold switches select a value corresponding to the number of pulses below which a flame is judged to be of unacceptable quality. In the presently described embodiment, switches 54 and 56 select among 8 possible threshold values indicating the number of pulses which must be received from the flame scanner tube during the preceding FFRT interval to indicate an acceptable flame. In the present embodiment, the lowest value is equal to 1 pulse per second, and successive values are larger by a factor of 2, so that the range of threshold values lies between $2^0$ through $2^7$. It should be clear that other ranges and/or additional threshold values may be selected or necessary for different applications.

Marginal threshold switch 50 selects an incremental value which is added to the threshold selected by switches 54 and 56 to provide a marginal alarm range. Should the number of pulses from the flame scanner tubes fall between the threshold value and the marginal threshold value, the flame analyzer provides a marginal alarm output signal by setting flip-flop 61 to indicate that the flame quality is approaching the threshold level. In the described embodiment, the marginal alarm ratio has 5 possible values ranging from $2^0$ through $2^4$, each successive value differing by a factor or 2. The marginal threshold is equal to the threshold selected by switches 54 or 56 multiplied by the factor selected by marginal threshold switch 50.

The signals from marginal threshold switches 50 and from multiplexer 58 constitute 6 of the second 8 inputs to multiplexer 48. One of the remaining signals is provided by a FFRT selection switch 62. Switch 62 connects one input of multiplexer 48 either to the supply voltage or to line 64 which is normally low, as described below. Switch 62 selects the flame failure response time, and generally selects between one second and four seconds, corresponding to European requirements and American requirements respectively. The final input to multiplexer 48 is a "check" signal which disables the flame-present and marginal alarm outputs but allows the flame analyzer to function normally otherwise. This is used in troubleshooting the analyzer and the furnace burner and is also used to disable analyzer during certain control sequences in normal furnace burner operation.

In order to verify that the flame scanner tube and electronics are operating properly, a shutter, located between the scanner and the flame, is periodically closed. During this time, processor 20 monitors the outputs from the flame scanners. If signals are produced which indicate that the flame scanner tube is providing pulses even when the shutter is closed, the processor senses this condition and provides a no-flame output signal. This would result, for example, from a runaway scanner tube or a stuck shutter.

In the presently described embodiment, the flame scanner shutter is closed for a one-half second "test period" once every 4 seconds. This is done by providing a signal at the flag-1 output from processor 20 to a shutter amplifier 64 which actuates the flame scanner shutter mechanism. During the first one-eighth of a second of each test period, the flame scanner tube is allowed to quench. During this initial one-eighth second period, the operation of one-shot 44 and counter 46 is checked, as described below. The counter is then monitored for the final three-eights second of each test period; and if one or more pulses are produced by the flame scanners during three consecutive test periods, the processor determines that there has been a shutter or flame scanner tube failure. In this manner, safe operation of the flame scanners is ensured. Should the shutter stick closed or the flame scanners malfunction in a manner that produces fewer or no pulses than should be the case, the system will err on the safe side in determining the flame quality or will shut down if no pulses are produced. Thus, malfunctions of the shutter and flame scanners cannot result in an unsafe condition.

The proper operation of one-shot 44 and counter 46 is checked by processor 20 in the following manner. The signal from the flame scanners is normally applied to one-shot 44 by multiplexer 42. The select input to multiplexer 42 is provided at the flag-2 output from processor 20. A second input to multiplexer 42 is provided directly from processor 20 and is taken from the microprocessor serial output. During the first part of the time period, the flag-2 output from processor 20 changes state so that one-shot 44 can now be clocked directly by the processor. The processor then reads the value in counter 46. Next, processor 20 clocks one-shot 44 by providing the appropriate signal at the serial output. After a 22 microsecond delay, the one-shot is again clocked to verify that it is not retriggering. If the one-shot is retriggerable, the one-shot pulse length will be extended 22 microseconds by the second clock pulse. The output from one-shot 44, applied to the sense input of processor 20, is timed by processor 20 to verify that one-shot 44 has the correct pulse length. Following the end of the output pulse from one-shot 44, the value in counter 46 is again checked to determine that it has properly been incremented by one bit. In this manner, the operation of the one-shot and the 8-bit counter are checked by the processor.

The proper operation of the threshold switches and the FFRT switch are also checked during the scanner shutter period. During the 3½ second non-test period, the flag-1 output from processor 20 is high. This signal is inverted by an inverter 66 to provide a low signal on line 67 and applied to the common terminals of threshold switches 50, 54, and 56. The output from inverter 66 is also applied by a line 64 to the "4 second" terminal of FFRT switch 62.

The 3 lines designating each of the 3 threshold values, connected to multiplexers 48 and 58 are connected to the supply voltage via respective resistors 68. When the threshold switch associated with one of these lines is open, the corresponding multiplexer input value is high. When the threshold switch is closed, the multiplexer input is connected to line 67 through the threshold switch and goes low. Threshold switches 50, 54, and 56 are preferably implemented by means of a type of switch which cannot fail in a shorted condition, such as a printed-circuit thumbwheel switch. If the switch fails in an open condition, which might be caused, for example, by switch contact contamination, the result is a higher threshold value; and while this may result in the burner system being shut down, an unsafe condition does not result.

Even though the threshold switches themselves cannot fail in a shorted condition, other failures can occur which result in one or more of the threshold signals applied to processor 20 being clamped low. One such condition, for example, would be if the output of one of the multiplexers shorted to ground. In this case, the thresold value indicated to processor 20 would be below the value actually selected, which might result in a dangerous condition. In order to guard against this possibility, processor 20 causes the signal applied to inverter 66 to go low during the test period. In response, the output of inverter 66 goes high, causing all of the lines from the threshold switches to go high. Processor 20 reads outputs from multiplexer 48 during the test period, and if one or more bits are low, the processor determines that a malfunction exists, and a no-flame output signal is provided.

The output signal from inverter 66 is also applied on line 64 to switch 62. Thus, during the test periods, the flame failure response time signal from line 62 should be high. This guards against switch 62 shorting to ground. If the signal from switch 62 is clamped high, this malfunction is not detected. This condition, however, can only result in a shorter flame failure response time and will not result in an unsafe condition.

Figure 2:
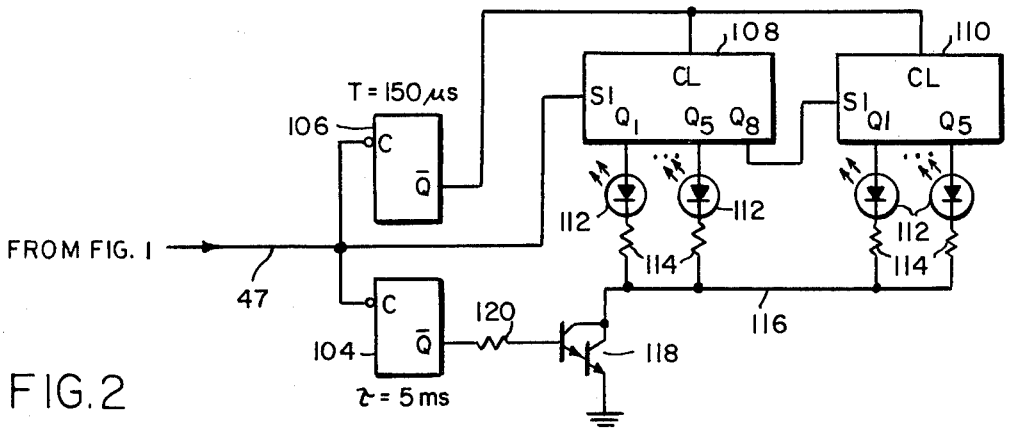
FIG. 2 shows a novel display for use with the circuitry of FIG. 1.

Processor 20 provides an output for driving a unique "bar-graph" type of display which indicates the flame quality. This display is shown in FIG. 2 and is described in detail below. The signals from processor 20 to the bar-graph display are in the form of pulse-width-modulated signals. These signals are provided by processor 20 from its serial output and are applied to a NOR gate 43 by inverter 41. The signal from the flag-2 output of processor 20 is also applied to NOR gate 43. Normally the flag-2 output is high, and the signals from the serial output are transmitted by NOR gate 43 to the bar-graph display via inverter 45. As described above, flag-2 output goes low during test periods to allow the serial output of processor 20 to directly clock one-shot 44. When this happens, the output from inverter 41 goes high disabling NOR gate 43 and preventing the one-shot test pulses from being transmitted to the bar-graph display.

In addition to the bar-graph display, a signal is provided from the flame analyzer for providing an indication of flame quality via a conventional analog meter. Processor 20 periodically applies signals via address bus 24 to a 10-bit latch 28, and these signals are clocked into the latch circuit. Each of the latch outputs $Q_1$ and $Q_{10}$ is connected to a node 74 by means of a respective resistor 76. A resistor 78 connects node 74 to the power supply voltage. One terminal of an analog meter 80 is connected to node 74 and a second terminal of the meter is connected to the supply voltage by a resistor 82. In the presently described embodiment, meter 80 is typically a voltmeter having a 3-volt full scale reading.

The described embodiment of the invention is adapted to work with a burner control system having a low frequency system clock signal. Typically, the clock signal is integrally related to the power line frequency, which is 60 Hz in the described embodiment. As shown in FIG. 1, a 120 Hz clock signal is applied to a one-shot 84. The output from one-shot 84 is applied to the interrupt input of processor 20 and provides a real time signal which the processor uses in timing its operations. One-shot 84 preferably has a long duty cycle, typically 90% to 95%, and is non-retriggerable to reduce the susceptability of the system to noise transients in the system clock signal.

In the present embodiment, a 60 Hz squarewave signal, synchronous with the 120 Hz clock signal, is provided by the burner control system. Flip-flop 88 is clocked by the flag-3 signal from processor 20. The output of flip-flop 88 provides a flame-present or no-flame output signal which indicates whether or not the flame quality is above the threshold level. The flame signal is produced in the following manner.

In response to a pulse from one-shot 84, applied to the interrupt input of processor 20, the processor increments its real time clock and then decides whether a flame is present, based on the current 4 second total and 32 second average. If the processor determines that a flame is present, the flag-3 output clocks flip-flop 88. This sequence occurs for each half cycle of the 60 Hz squarewave signal; and thus, if a flame is present, the signal from flip-flop 88 is a 60 Hz squarewave, synchronized with respect to the 60 Hz system clock. If processor 20 determines that a flame is not present, the flag-3 output is not changed and flip-flop 88 is not clocked. The resulting signal from flip-flop 88 is a continuous high or low signal. This method of providing a flame signal ensures that a flame-present signal cannot be erroneously produced by an open or short circuit in one of the logic circuits involved.

Referring to FIG. 2, there is shown a bar-graph display circuit which can be driven by the flame analyzer circuit shown in FIG. 1. As described above, the signals from processor 20 appear as pulse-width-modulated signals on line 47. These signals are applied to the clock inputs of two one-shots 104 and 106 and also to the serial input of a shift register 108. Shift register 108 is an 8-bit, serial-in-parallel-out shift register. The $Q_8$ output from shift register 108 is applied to the serial input of a second shift register 110 of a similar construction to shift register 108. Shift registers 108 and 110 are clocked by the $\overline{Q}$ output from one-shot 106.

Connected between each of the first 5 outputs, $Q_1$ through $Q_5$, of each of shift registers 108 and 110 are 10 LED's 112. In series with each LED is a current-limiting resistor 114 which connects the LED to a line 116. Line 116 is connected to the collector terminal of a Darlington transistor 118 which, in response to signals applied to its base, connects line 116 to ground. Darlington transistor 118 is turned on and off by the $\overline{Q}$ output from one-shot 104 which is applied to the base terminal of Darlington transistor 118 through a current-limiting resistor 120.

The bar-graph display shown in FIG. 2 operates in the following manner. The data to be displayed by the bar-graph display is transmitted on line 47 as pulse-width-modulated signals. Each bit to be displayed is represented by a pulse, and the width of the pulse determines whether the corresponding LED is lit. In the present embodiment, short pulses denote lighted LED's and are approximately 100 microseconds long, and long pulses denot unlighted LED's and are approximately 200 microseconds long. The signal on line 47 is normally high, and the pulses transmitted to the bar-graph display are low. The one-shots are both triggered by falling edges, and thus are triggered by the leading edge of each pulse. After 150 microseconds, one-shot 106 times out, and the $\overline{Q}$ output of one-shot 106 returns high, clocking shift registers 108 and 110. If the signal on line 47 represents an unlit LED, the signal will still be low when the one-shot times out; and a zero is clocked in to the first stage of shift register 108. If the signal represents a lighted LED, the signal will have returned high when shift register 108 is clocked, and a one is clocked into shift register 108. In this manner, the width of the pulses on line 47 determines the digital values clocked into the stages of shift registers 108 and 110.

The period of one-shot 104 is approximately 5 milliseconds long. One-shot 104 is preferably non-retriggerable and is clocked by the leading edge of each pulse train, causing the $\overline{Q}$ output from one-shot to go low. This disables the display LED's 112 during the periods that data is being shifted into and through shift registers 108 and 110.

In the present embodiment, the bar-graph displays several different types of data. Normally, with an acceptable flame quality, a continuous bar of lighted LED's is representative of the flame quality. When the flame quality falls below the marginal threshold, the flame analyzer continues to display a bar of LED's which represent the flame quality value, and in addition the flame analyzer causes the LED corresponding with the threshold value to blink on and off. This provides both an indication that the flame quality is marginal and also an indication of the amount by which the flame quality is marginal. The bar-graph display shown in FIG. 2 is also used to provide diagnostic information in the event that a malfunction in the flame analyzer circuitry is detected. In response to the detection of different failures, different patterns are displayed by the bar-graph display to provide an indication of the particular failure which shut down the furnace system. Especially where the failure is intermittent or is hidden by the process of shutting down the furnace system, such diagnostic information is very helpful in finding and correcting the malfunction.

Referring to FIGS. 3–6 there are shown several diagrams which illustrate one type of procedure which may be carried out by the flame analyzer in performing the flame quality evaluation.

As described above, for $3\frac{1}{2}$ seconds out of every 4 second period, the flame analyzer continuously evaluates the flame quality based on the flame scanner outputs and the selected threshold values. During $\frac{1}{2}$ of each 4-second period, the scanner shutter is closed to verify the proper operation of the scanner tube. During this $\frac{1}{2}$-second period, the scanner, counter, one-shot, and shutter operation are verified.

Figure 3:
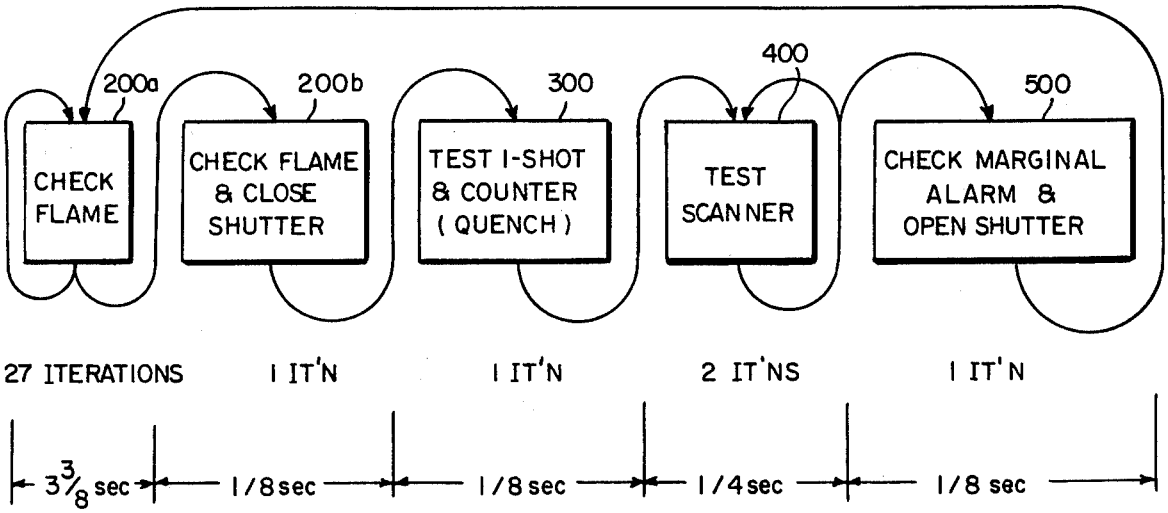

Each 4-second segment is further divided into $\frac{1}{8}$-second intervals. During each $\frac{1}{8}$-second interval, the flame analyzer may perform one of several procedures. FIG. 3 generally illustrates the operations carried out by the flame analyzer during each of the $\frac{1}{8}$-second intervals in a 4-second period. These operations are shown and described in more detail below in connection with FIGS. 4 and 5.

During the first $3\frac{1}{2}$ seconds of each 4-second period, the flame analyzer system reads the counter outputs periodically and computes the flame quality based on the number of pulses received. A 4-second pulse total and a 32-second average are computed, and if these values indicate an unacceptable flame quality, the flame analyzer provides a no-flame output signal.

This is done by a "check flame" operation, block **200*a*, which requires $\frac{1}{8}$-second to complete. As shown in FIG. 3, the check flame operation represented by block 200*a* is repeated 27 times over a $3\frac{5}{8}$ second period. After the 27th iteration of block 200*a* the flame analyzer proceeds to block 200*b*. In block 200*b*, the same check flame operation is carried out as in 200*a*, except that the flame analyzer sends a signal to the scanner shutter to close the shutter at the end of the interval. Block 200*b*** requires $\frac{1}{8}$-second. Thus, over the first $3\frac{1}{2}$ seconds of each 4-second interval, the flame scanner output pulses are monitored, and an evaluation of the flame is made at the end of each $\frac{1}{8}$-second interval.

Following the sending of a command to close the scanner shutter, the flame analyzer allows $\frac{1}{8}$-second for the scanner shutter to close and for the scanner tube to quench. During this time, the proper operation of one-shot 44 and counter 46 is verified, block 300.

From block 300, the flame analyzer proceeds to block 400 where the scanner tube and shutter are tested. During block 400, the counter output is read to verify that it is not being incremented. If the counter is still being incremented, this indicates a stuck shutter or a malfunctioning scanner tube. The operation of block 400 is repeated once, requiring a total of $\frac{1}{4}$ second.

After block 400 has been performed twice, the flame analyzer proceeds to block 500. In block 500, the flame quality index is checked against the marginal threshold, and if the marginal threshold is not met, a marginal alarm signal is provided. During block 500, the scanner testing routine is repeated. At the end of block 500, the shutter is opened in preparation for the next 4-second period. The flame analyzer then returns to block 200*a* and the above-described sequence of operations is repeated.

Figure 4:
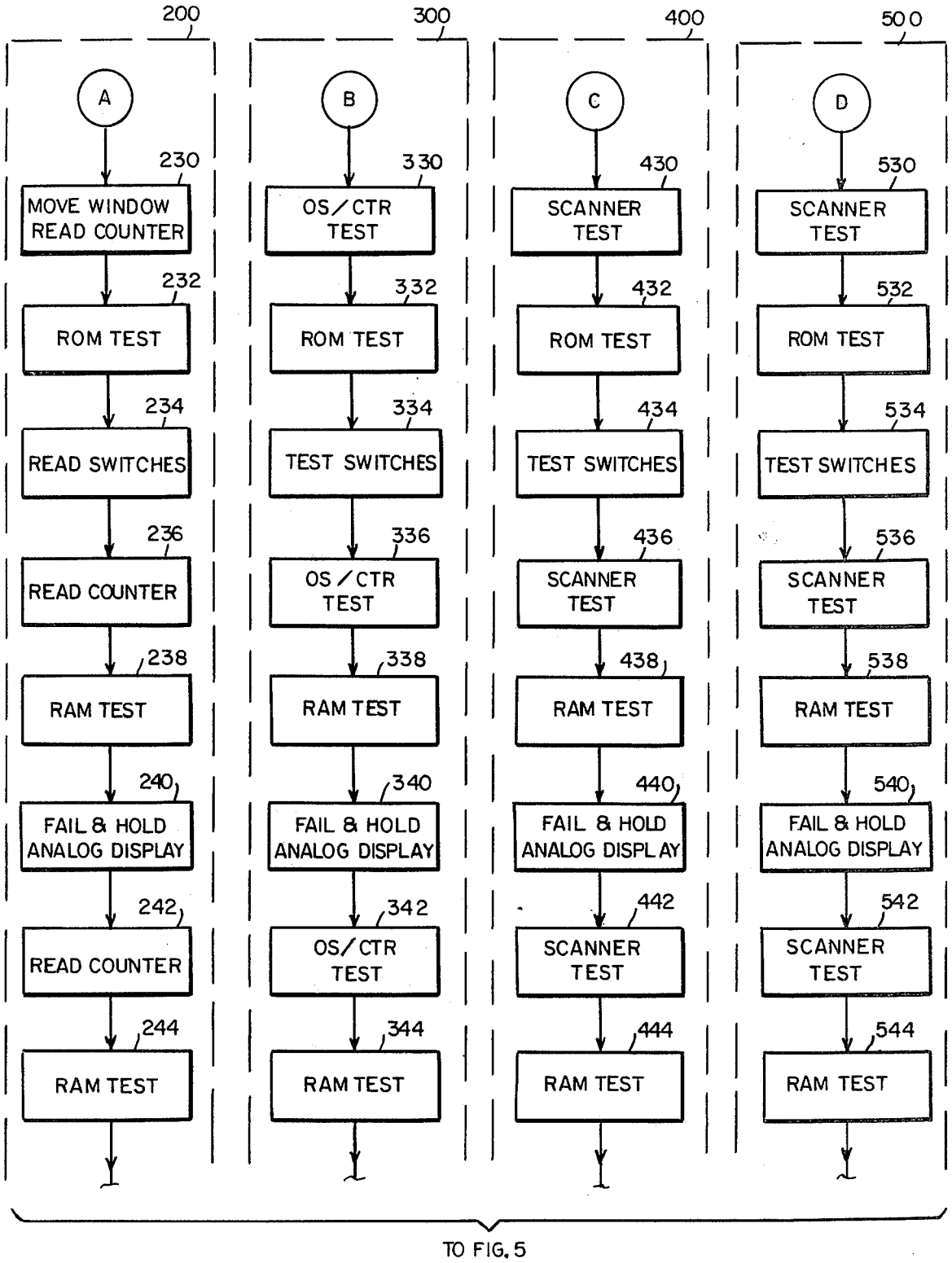
Figure 5:
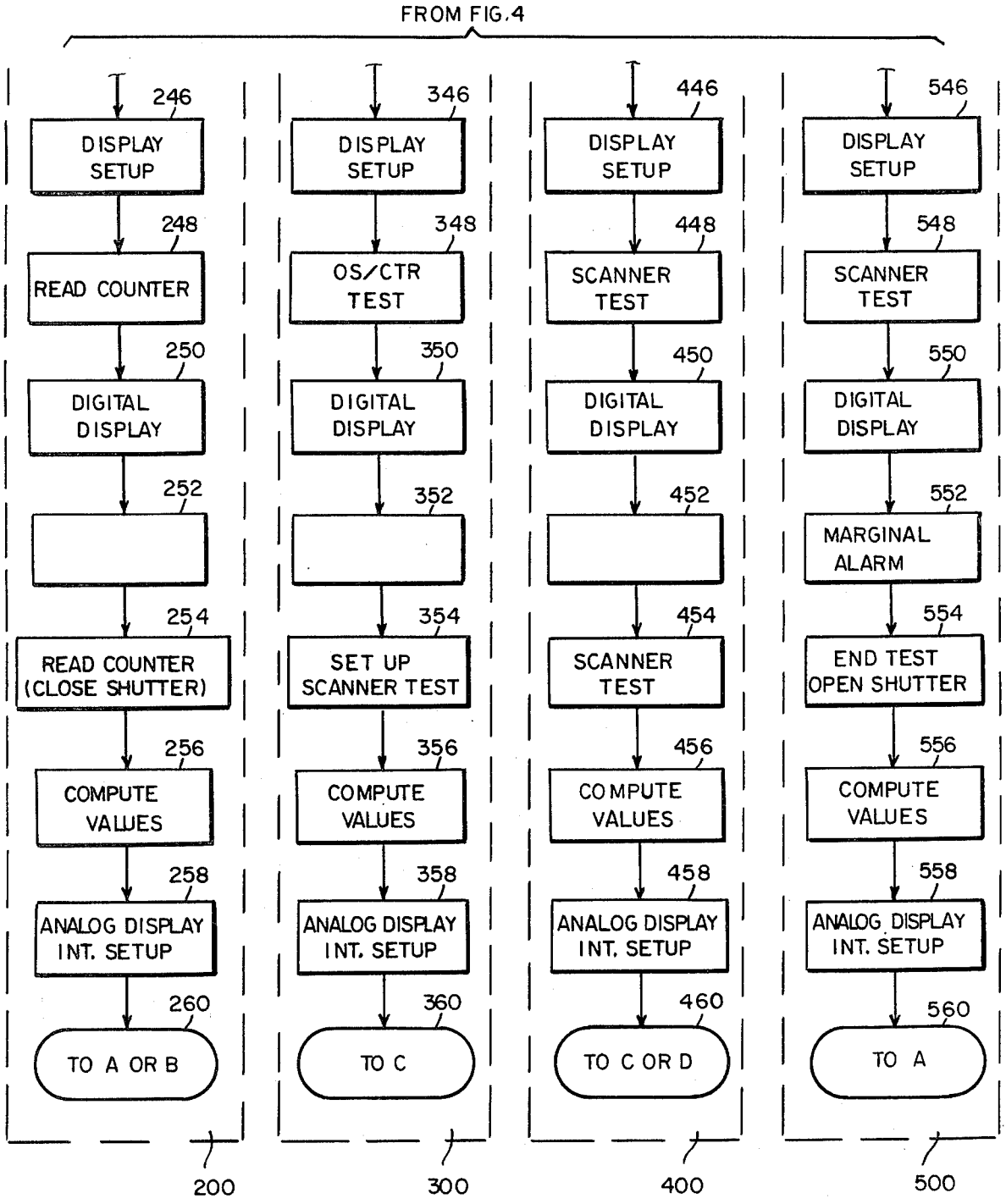

A diagram which shows in detail the operations of FIG. 3 is shown in FIGS. 4 and 5. Each column in FIGS. 4 and 5 corresponds with one of the operations carried out by the flame analyzer during one of the blocks shown in FIG. 3; and thus, each column requires $\frac{1}{8}$-second to execute. Each column is composed of 15 segments, represented by individual blocks, during which a particular function is performed. Each of the blocks shown in FIGS. 4 and 5 requires 8.33 milliseconds, or $\frac{1}{2}$ cycle of a 60 Hertz power line signal. Executing each block in this manner allows the flame analyzer to work in synchronism with a burner control system which uses the 60 Hertz power line as a master clock.

Figure 6:
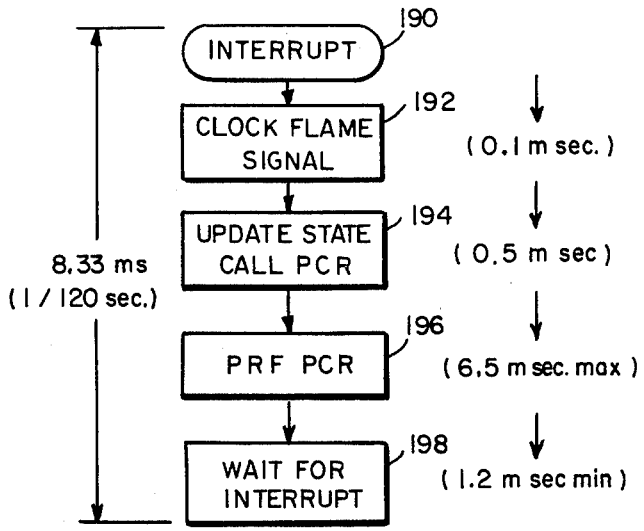
FIGS. 3–6 are diagrams useful in explaining the operation of the present invention.

The general sequence of operations performed by the flame analyzer during each 8.33 milliseconds interval is shown in FIG. 6. As explained above, the system clock is applied via one-shot 84 to the interrupt input to processor 20. Once each 8.33 milliseconds of a second, the processor receives an interrupt. This is represented by block 190 in FIG. 6. In response to the interrupt input, flame analyzer 20 carries out the following procedures.

Immediately after being interrupted, the flame analyzer must determine whether or not to clock the output flip-flop 88 to provide a flame-present signal, block 192. To do this, the flame analyzer retrieves an index variable stored in a flame analyzer status register which indicates whether the flame quality is acceptable, based on previous calculation, and whether the flame analyzer is functioning properly, as determined by the system diagnostics. If the analyzer is functioning properly and the flame is judged to be of acceptable quality, processor 20 raises and then lowers the flag-3 output to toggle D flip-flop 88. If flame quality is not satisfactory, or if a malfunction has been detected, flip-flop 88 is not clocked, and the output signal indicates a no-flame condition. This procedure takes approximately 0.1 millisecond.

Next, the processor updates an internal, real-time clock to reflect the fact that 8.33 milliseconds have passed since the last interrupt signal was received, block 194. At this time, the processor determines what procedure is to be carried out during the present power line half-cycle and calls that procedure. These procedures are described in detail below in connection with FIGS. 4 and 5. The interrupt input is disabled during block 194 to prevent the processor from being interrupted by a noise pulse on the system clock line. The execution of block 194 requires approximately 0.5 milliseconds.

The processor next proceeds to execute the particular procedure which is called for during the present interval, block 196. It is during this time that the counter outputs are read, the threshold values are read, the flame quality is determined, and the various parts of the system are tested. Each of these functions is described in detail below. The procedures are structured such that no procedure requires more than 6.5 milliseconds maximum to complete.

Following the end of the procedure performed during block 196 the processor re-enables the interrupt input and waits for the next interrupt signal, block 198. The duration of block 198 varies, depending upon the execution time of the procedure performed in block 196. Thus, the entire series of operation shown in FIG. 6 is completed in less than 8.33 milliseconds, and the processor is ready to perform the next operation in response to the next clock signal from the burner control system applied to the interrupt input of the processor.

Returning to FIGS. 4 and 5, the left-most column represents the check flame operations of blocks 200*a* and 200*b* in FIG. 3, during which the flame quality is evaluated.

The first procedure carried out during each check flame operation is to move the time-window over which the pulses are accumulated and read counter 46, block 230. To move the time-window, the processor first determines if this is the first check flame interval of a 4 second interval. If so, a new counter value is obtained, since the diagnostic procedures have changed the counter value.

The time-window is incremented in the following manner. The 4-second total is calculated by adding the pulses received during $28\frac{1}{8}$ second intervals. (No flame pulses are counted during $\frac{1}{2}$ second of each 4 second period, when the scanner tube, shutter, and flame analyzer circuitry are checked.) The flame analyzer includes 28 storage registers. Each of the registers has stored therein the number of pulses for a $\frac{1}{8}$-second interval. A pointer indicates the address of the register corresponding with the current interval. To begin each interval, the pointer is incremented by one register. At this time, the the currently-addressed register contains the number of pulses received during the interval which occurred 4 seconds previously. The contents of the currently-addressed register are read and subtracted from the previous 4-second total calculated by the flame analyzer. The register is then set to zero.

Following the zeroing of the currently-addressed register, the counter is read and the difference between the present counter value and previous counter value is calculated. This value is then added to the value in the currently-addressed register. When the counter is being read, processor 20 causes its select input to go low, disconnecting one-shot 44 from the flame scanners. This prevents counter 46 from being clocked while it is being read, which might result in an erroneous value being read by the processor.

Next, the processor performs a test of the read only memory 30 to verify that it is operating properly, block 212. The ROM diagnostic routine verifies the ROM operation using the wellknown "checksum" process. The first location in the ROM contains the ROM's checksum value, which is the exclusive-or sum of the data in the remaining memory locations in the ROM. Should any bit in the ROM change, the checksum changes, signaling a ROM failure. This test also verifies the proper operation of the lower 11 bits of the address line, as addressing malfunctions will also result in an incorrect checksum. During each 8.33 milliseconds cycle, eight memory locations in the ROM are summed. Thus, 32 seconds are required to completely verify the entire ROM. After the entire ROM has been examined, the checksum should have a value of zero. If not, a malfunction exists, and the appropriate value is loaded in the flame analyzer status register. This register is periodically checked, as described below, and if a malfunction exists, the appropriate diagnostic display is loaded into the bar-graph and a no-flame output signal is provided.

Following block 232, the flame analyzer next reads the threshold values selected by the threshold switches, block 234. The flame analyzer obtains the threshold and the marginal threshold values from the threshold switches, as well as the check and flame failure response time inputs. The processor provides debouncing of the input signals from the threshold switches to prevent acceptance of incorrect values due to intermediate switch positions or momentary electrical noise. To read the switch values, the address designating the threshold switches is applied to the address bus. In response, address decoder 26 enables multiplexer 48 and causes multiplexer 48 to select the multiplexer inputs connected to the threshold switches. The selected threshold values are then read and compared with the last reading. For the processor to determine that a new threshold value has been selected, the same value must be read by the processor three consecutive times. To determine this, the processor reads the switch value and compares this with the last reading stored in a temporary register. If the reading is different, the new reading is stored in the register, and an index register is set to one. When the switches are next read, the index variable is incremented if the value read agrees with the value previously read. When the index register reaches 3, the new value is determined to be a valid threshold value and is stored by the flame analyzer.

After completing block 234, the flame analyzer agains reads the value in counter 46. Counter 46 is an 8-bit counter which recycles upon overflow. Since pulses may be produced by the flame scanner at a very rapid rate, counter 46 must be read sufficiently often that the counter cannot recycle without this being detected. Otherwise, an erroneous reading may be accepted by the processor. The read counter routine first obtains the current register address (discussed above in connection with block 230) and then reads the value in counter 46. The number of pulses since the last time the counter was read is determined by calculating the unsigned difference between the previous counter reading and the current counter reading. This value is then added to the value in the currently-addressed register.

The flame analyzer next verifies the proper operation of random access memory 32, block 238. The RAM diagnostic routine verifies the proper operation of both the RAM and the data lines. The RAM is tested one memory location at a time. On entry to the RAM testing routine, the content of the memory location being tested is stored in an internal register of processor 20. Two test patterns are then stored in and read from the RAM. The two test patterns both consist of alternating 1's and 0's, one pattern storing 1's in odd bits and the other pattern storing 1's in even bits. This test verifies that no RAM memory elements or data lines have short or open circuits and also verifies that data can be stored and retrieved correctly from the present location in the RAM. One memory location is exercised during each iteration of a RAM test cycle, such as block 238. Two such RAM test cycles occur during each $\frac{1}{8}$-second interval, and thus all 128 memory locations in the RAM are tested every 8 seconds. If a RAM failure is detected, the appropriate value is stored in the flame analyzer status register.

The flame analyzer then proceeds to block 240. If a malfunction has been previously detected by one of the flame analyzer test routines, the analyzer status register contains data which indicates that a malfunction has occurred and the type of malfunction which has been detected. During block 240, the status register is checked to determine whether a malfunction has been detected. If so, the appropriate diagnostic display is sent to the bargraph display, the analog meter is zeroed, and the processor proceeds into an endless loop state, which effectively halts the operation of the flame analyzer. Since the D flip-flop 88 is no longer clocked, the flame-present signal disappears.

During block 240, if a failure has not occurred, the processor transmits the appropriate data to latch circuit 28 for driving the analog meter. This is done in the following manner. First, the processor retrieves the value produced by the display set-up routine, described below in connection with block 258. If a winking bit is present, indicating that the flame quality falls below the marginal threshold, this bit is masked out. In the described embodiment, a reading of 1 on the meter represents the current threshold and corresponds with an output to the meter in which the first 3-bits are high; and the retrieved value is shifted so that the meter output is properly scaled. Next, the address of latch 28 is loaded into the higher order address bits, and the data to be loaded into the latch is put in the lower order address bits. The processor then performs a read operation from the designated location, which strobes latch circuit 28 storing the desired data in the latches.

Following the completion of block 240, the processor proceeds to block 242 where the counter is again read. This procedure is identical to that described above in connection with block 236. The processor next performs another RAM test cycle, block 244, as described above in connection with block 238.

The processor then proceeds to perform a display set-up cycle, block 246. If the 4-second pulse total were displayed directly, a pattern of lit and unlit bits would result, due to the binary nature of the value. To display a "bar", the value is rounded down to the nearest lower power of 2. After this has been done, the data is then properly formated for loading into the bar-graph shift registers by inserting 3 dummy bits before the least significant bit of the value of 3 more dummy bits between the 5th and 6th bits of the value. These dummy bits are stored in the stages of the bar-graph shift register which are not connected to output LED's. Next, the processor determines whether the flame quality is below the marginal threshold. If so, the appropriate bit in the bar-graph must be winked. In the described embodiment, the winking bit has a duty cycle of $\frac{1}{8}$. This is accomplished by rotating a wink timer register each time the display cycle is performed and turning on the threshold bit only during one out of every 8 cycles when a marginal alarm condition is present.

Following block 246, the processor again reads counter 46, block 248.

Next, the processor outputs data to the bar-graph display, block 250. The value calculated during the display set-up routine, block 246, is used by the bar-graph display driver routine. This routine transmits the data to the bar-graph as serial data, outputting a long pulse each time a "0" is to be transmitted and a short pulse each time a "1" is to be transmitted.

Following block 250 is block 252. During this block no procedure is performed. Next, the processor proceeds to block 254 where counter 46 is again read.

The flame analyzer next computes various different values used to evaluate the flame quality and to drive the analog and digital displays, block 256. On entering this routine, the number of pulses accumulated in the currently-addressed register is first examined to see if it equals zero. If so, a flame-out timer counter is incremented; otherwise the counter is reset. This counter indicates the period during which no pulses have been received from the flame scanner, which would result from a complete flame-out. If this counter reaches 3.875 seconds (U.S.) or 0.875 seconds (European), depending on the position of switch 62, the processor determines that a flame-out has occurred and loads the appropriate value into the flame analyzer status register. Next, the current 4-second total is calculated by adding the value of the currently-addressed register to the 4-second total. Two-second and one-second average totals are calculated, for driving the bar-graph and analog meter displays, by shifting the 4-second total 1 and 2 bits respectively.

The 32-second average is then calculated in the following manner. The flame analyzer includes 7 registers which store the 4-second totals calculated at the end of each 4-second interval during the previous 28 seconds. The values in these registers are summed. This sum is added to the current 4-second total and shifted 3 times to obtain the average 4-second total for the previous 32 seconds, and this value is compared with the currently-selected threshold. A small error is introduced by this procedure for 32-second values computed during all but the last $\frac{1}{8}$-second of each 4-second interval, but these errors are generally small and may be neglected. At the end of each 4-second interval, the oldest 4-second total is replaced by the most recent 4-second total.

Following the computation of values in block 256, the flame analyzer then performs the actual evaluation of whether the flame quality is acceptable, block 258. The first test is whether a flame-out occurred. The analyzer checks to see if a 1-second or 4-second FFRT has been selected. The processor then compares the flame-out timer counter (discussed above in connection with block 256) with the selected interval, and if they are equal a flame-out has occurred.

If a flame-out has not just occurred, the flame analyzer next checks to see whether pull-in is required. As discussed above, a higher threshold is used to detect the first occurrence of a flame. If pull-in is required, the 4-second total must be greater than or equal to 2.5 times the threshold value, and the 32-second average must also be equal to or greater than the threshold. If either of these tests is not met, a no-flame condition continues.

If the flame was previously satisfactory, pull-in is not required; and the 4-second total is compared with the threshold. If the comparison indicates an unsatisfactory flame, a timer is incremented. Otherwise, the timer is reset. If the value in this timer reaches the interval selected by the FFRT switch, the flame analyzer determines that a loss-of-flame has occurred. Next, the flame analyzer tests to determine whether the 32-second average 4-second total is less than the selected threshold, and if so, the flame analyzer determines that a loss of flame has occurred.

Should any of the above tests indicate a loss of flame, the flame analyzer loads the appropriate no-flame value in the flame analyzer status register. Otherwise, the processor loads the flame-present value into the status register. If, however, the CHECK input 63 through the analyzer is high, indicating that the flame-present signal should not be provided, a flame-present signal is not loaded into the status register.

The completion of block 258 marks the passage of $\frac{1}{8}$-second since the check flame routing 200 began. The processor then repeats a check flame routine until 28 repetitions have been performed. As discussed above, on the 28th repetition the flame scanner shutter is closed during block 224 in preparation for testing the shutter and flame scanner.

After 28 repetitions of the check flame routine, the oneshot, counter, and switches are tested during the next $\frac{1}{8}$-second, column 300. The flame analyzer first verifies the proper operation of one-shot 44 and counter 46, block 330. On entering this segment the current value in counter 46 is read and saved in a temporary register location. Next, the flag-2 output from processor 20 is reset, causing multiplexer 42 to apply pulses from the serial output of processor 20 to the clock input of one-shot 44; and a pulse is provided by processor 20 at the serial output port to clock the one-shot. After a delay, another pulse is applied to the one-shot by processor 20 to test the non-retriggerability of the one-shot. If the one-shot has become retriggerable, the second pulse results in a pulse-width from one-shot 44 which is too long. The one-shot output is applied to the sense input of processor 20, and the state of the one-shot is checked first at 102 microseconds and again at 135 microseconds after the one-shot was initially clocked. The one-shot output must still be high at 102 microseconds but must have returned low at 135 microseconds in order for the processor to determine that the one-shot is operating correctly. After the one-shot is complete, the counter is again read. The new value must be exactly one count greater than the old value; otherwise the processor determines that the counter has failed. If either the one-shot or the counter has failed, the appropriate value is loaded into the flame analyzer status register.

Following the one-shot and counter test, the processor performs another ROM test, block 332.

Next, the processor tests the thumbwheel and other switches for safe operation block 334. As described above, the flag-1 output from processor 20 which drives the scanner shutter is also inverted and used to provide a ground reference siganl to the threshold switches and the FFRT switch. During the shutter-closed interval, the signal applied to the switches is high. To test these switches, they are read during the shutter-closed interval. If the switch outputs are not all high, the flame analyzer determines that the hardware has failed; and the appropriate value is loaded into the flame analyzer status register.

Next, the processor performs another one-shot and counter test, block 336. This is followed by a RAM test, block 338, a fail and hold segment, block 340, another one-shot and counter test segment, block 342, another RAM test, block 344, a display set-up segment, block 346, another one-shot and counter test, block 348, and a remote display segment, block 350. Following block 350, the processor does nothing for one segment, block 352.

Next, the processor sets up the scanner test routine, performed during the following two ⅛-second periods, by reading the current counter value and loading this into a temporary register, block 354. The processor completes the one-shot and counter test interval by computing the current 4-second and 32-second averages, block 356, and performing the flame evaluation, block 358. This marks the end of the ⅛-second one-shot and counter test interval. The processor then proceeds to the scanner test interval, block 360.

The scanner test interval is shown in column 400, and this procedure is repeated twice. As can be seen from FIGS. 4 and 5 the scanner test interval is identical with the one-shot and counter test interval, with the exception that scanner test segments in blocks 430, 436, 442, 448, and 458 are substituted for the corresponding one-shot and counter test segments of blocks 330, 336, 342, 348, and 354.

The scanner test assures that the shutter has, in fact, closed and that the scanner tube is not self-firing. Both of these failure modes are unsafe and result in the counter being incremented during the scanner test period. The scanner test consists of reading the counter during several segments and comparing the value with the value present at the beginning of the scanner test interval. If the counter value changes, a flag is set to indicate this fact. At the end of the scanner test, the flag is checked to see if the counter value has changed block 554. If so, a false-firing index register is incremented. Otherwise, the false-firing register is reset. If the false-firing register ever reaches 3, the scanner or shutter is considered to have failed, and the appropriate value is loaded into the analyzer status register. Requiring pulses to be detected during 3 successive shutter-closed intervals before the scanner or shutter is considered to have failed prevents nuisance shutdowns due to momentary noise or cosmic rays.

The final interval in each 4-second period is the marginal alarm check and open shutter interval 500. Each segment of this interval is identical to that of the scanner test interval except for the segments shown in blocks 552 and 554. During block 552, flame quality value is checked against the marginal alarm threshold to determine whether the flame has degraded to a marginal state. Marginal flame conditions are detected only once every 4 seconds. This is acceptable since a marginal flame is not an unsafe condition, but merely indicates that the flame quality is somewhat degraded. Upon entering the marginal alarm segment, block 252, the marginal alarm threshold is read from where it is stored in memory and used to calculate a marginal alarm value. The marginal alarm value is then subtracted from the current 32-second average. If the result is positive, the flame is not marginal; and the marginal alarm bit of the flame analyzer status register is reset, if set. A negative result, however, indicates a marginal flame; and the marginal alarm bit in the status register is set, indicating that a marginal flame condition exists. After the marginal alarm is checked, the scanner shutter is opened in preparation for the next check flame procedure, block 554. The necessary values are computed, block 556, and the proper data is sent to the analog display, block 558. This completes one 4-second interval. The flame analyzer then returns to the beginning of the check flame procedure 200, and the above-described series of operations is repeated.

It should be appreciated that the procedures described above are exemplary and may be modified in adapting the present invention for use in different situations. For example, European requirements generally include a FFRT of one second, rather than the four second FFRT which is standard in the U.S. To accomodate this difference, the flame analyzer time-window may be reduced to one-second, and the number of iterations and durations of the different procedures changes as shown in Table 1.

Figure 7:
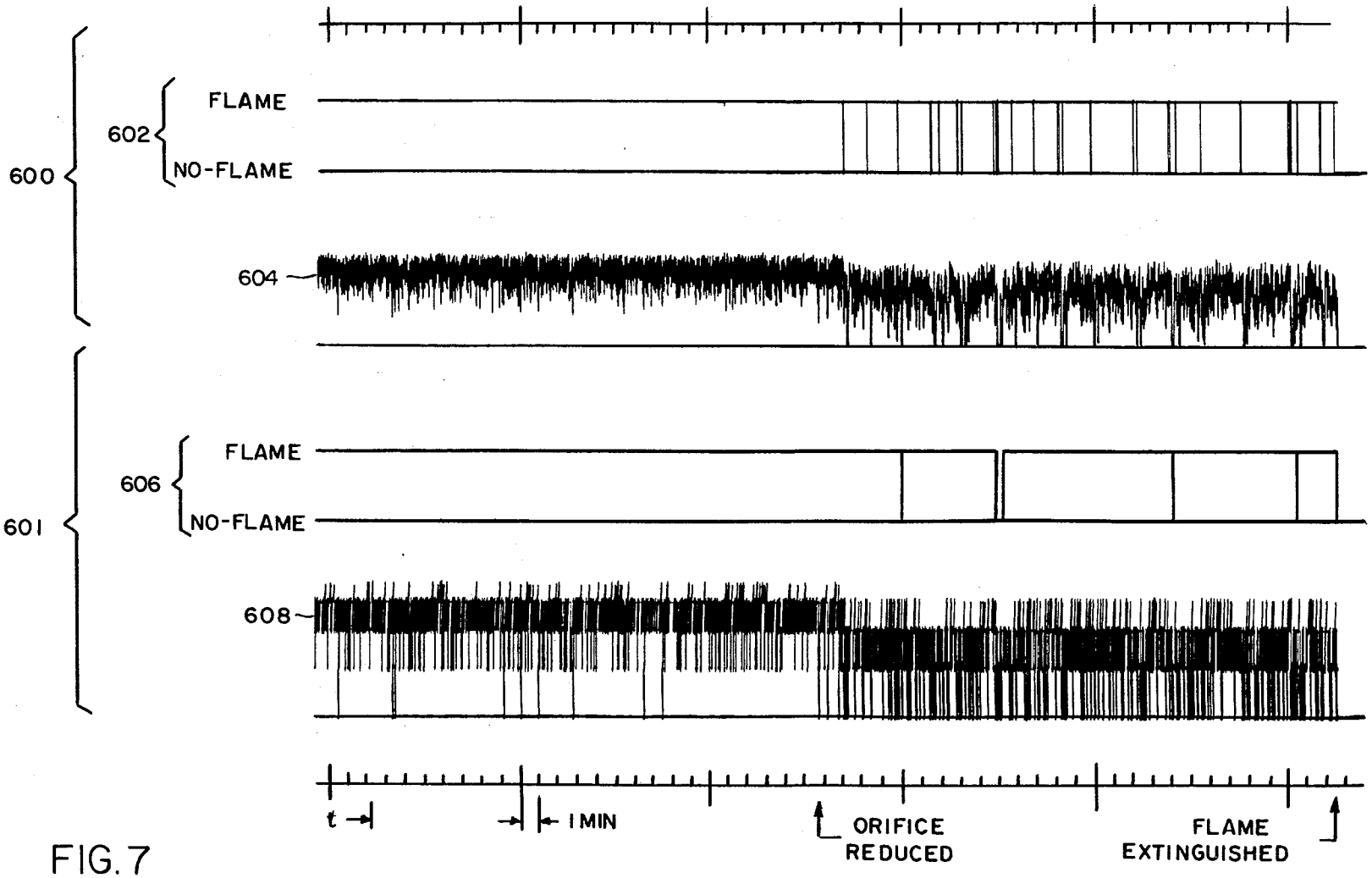
FIG. 7 shows waveforms illustrating the advantages of the present invention over the prior art.

Referring to FIG. 7 there are shown test results comparing a typical prior art flame analyzer with the present invention. In the test from which the waveforms of FIG. 7 were derived, a gas-fired burner was employed and was continuously burning throughout the time period shown in FIG. 7. In this test, the prior art flame analyzer was operated simultaneously with the flame analyzer of the present invention. A single flame sensor was used to provide identical input signals to the two flame analyzers, and the flame analyzer performance was monitored as the simulated flame quality was varied. In this test, a U.V. scanner tube was aligned so that it was exposed to the edge of the burner flame. The scanner used was an ECA type 45UV5,Model 1000, U.V. scanner tube. A variable-size orifice was interposed between the flame and the scanner tube to simulate a low quality flame and to allow the simulated flame quality to be varied during the test. The flame analyzer with which the present invention was compared is an ECA flame analyzer type 25SU3, Model 4163, Code 15. This flame analyzer is representative of the most advanced of prior art flame analyzers.

In FIG. 7 the top two waveforms 600 were produced by the prior art flame analyzer, and the bottom two waveforms 601 were produced by the previously-described embodiment of the present invention. Waveform 602 in FIG. 7 represents the flame signal output from the prior art flame analyzer. This output takes one of two states, indicating a flame-present or no-flame condition. The next waveform 604 in FIG. 7 is an analog output representative of the flame quality provided by the prior art flame analyzer.

Waveform 606 represents the flame signal output produced by the present invention and varies between two states, indicating a flame-present and no-flame condition, similar to waveform 602. Waveform 608 represents the analog output produced by the present invention for driving meter 80, shown in FIG. 1. As discussed above, the signal applied to meter 80 is not a continuous analog signal but varies between discrete levels, as can be seen in FIG. 7. The time scale of FIG. 7 is one minute per division, as shown.

In the waveforms shown in FIG. 7, the threshold and sensitivity settings of the present invention and the prior art device were set at equivalent levels. (Due to the different methods of evaluating flame quality used by the prior art device and the present invention, the sensitivity and threshold settings cannot be compared or equated exactly.) During the initial part of the test, the orifice was set to a size which resulted in continuous flame-present signals being produced by both systems. The outputs from both systems during this time are shown in the left-hand portions of the waveforms in FIG. 7. Next, the orifice size was reduced to a level which provided a signal from the flame scanner tube equivalent to a very marginal flame.

As can be seen in FIG. 7, the flame signal output from the prior art flame analyzer in response to the simulated low quality flame signal frequently indicated a no-flame condition. Over the approximately 28 minute period of low quality flame operation shown in FIG. 7, the prior art device indicated a no-flame condition approximately 26 times. Over the same interval, the present invention went to a no-flame condition only 4 times. The test was terminated by extinguishing the flame; and as can be seen from FIG. 7, both the prior art flame analyzer and the present invention immediately indicated a no-flame condition.

The above-described comparative tests are exemplary of the improved performance which is achieved by the present invention. As can be seen, under marginal flame conditions such as those simulated in FIG. 7, the present invention performs significantly better than prior art devices. The conditions shown in FIG. 7 are merely exemplary; and under other conditions the improvement in performance of the present invention over the prior art may be greater or lesser than that shown in FIG. 7.

In some burner installations, a no-flame indication results in a furnace being shut down and an alarm signal being sounded. In other installations, upon a loss of flame indication, the furnace will recycle and attempt to reignite the furance flame. In either case, however, it should be clear that the reduction in number or elimination of erroneous no-flame output signals provided by the present invention result in significant benefits and economies.

There has been described a method and apparatus for implementing a flame analyzer device which has improved performance and numerous advantages over previously-known devices for performing such a function. It should be apparent that modifications to the preferred embodiments disclosed herein will be made in applying the teachings of the present invention to different situations, and such modifications should not be considered as falling outside the scope of the present invention. Accordingly, the present invention should not be considered to be limited by the exemplary embodiments disclosed, but should only be interpreted in accordance with the following claims.

TABLE 1

| Procedure | Duration U.S. (4 sec FFRT) | Duration European (1 sec FFRT) |
|---|---|---|
| Check flame (200a) | 3.375 sec | .625 sec |
| Close shutter (200b) | .125 sec | .125 sec |
| Test one-shot (300) | .125 sec | .125 sec |
| Test scanner (400) | .250 sec | 0.000 sec |
| Open shutter (500) | .125 sec | .125 sec |

What is claimed is:

1. A method for providing a signal representative of the quality of a flame in a burner system of the type including a burner for producing a flame and a flame sensor responsive to the burner flame for providing signal pulses representative of the flame, the method comprising the steps of:

defining a series of successively-occurring time intervals; counting the number of pulses produced by the flame sensor during each interval;

storing the number of pulses produced during each of a selected number of preceding intervals, the duration of said selected number of intervals defining a first period of time;

periodically determining the number of pulses produced during the preceding first period of time to define a total number equal to said number of pulses produced during the preceding first period of time;

comparing said total number with a threshold value to determine when said total number is below the threshold value and providing a signal representative thereof.

2. The method of claim 1 wherein the step of storing includes:

providing a plurality of registers, at least equal in number to said selected number; and storing data in the registers representative of the numbers of pulses occurring during successive intervals, each register being associated with the interval for which data is stored therein, the data being stored such that data associated with the most recent interval is stored in the same register as and replaces the data associated with the oldest interval for which data is stored in the registers.

3. The method of claim 1 wherein the method further provides a no-flame signal representative of a no-flame condition in the burner, and further comprising the steps of:

defining a second period of time;

determining that a no-flame condition is present when said total number has continuously been below the threshold value for a duration equal to the second period of time; and providing a no-flame signal so long as a no-flame condition is determined to be present.

4. The method of claim 3 further including the step of:

requiring, when a no-flame condition has been determined to be present, that said total number exceeds a pull-in value before determining that the existing no-flame condition has ceased.

5. The method of claim 4 wherein the pull-in value is equal to the threshold value multiplied by a selected factor.

6. The method of claim 5 wherein the selected factor is approximately 2.5.

7. The method of claims 1, 2, 3, 4, 5, or 6 further including the steps of:

defining a second threshold value;

defining a third period of time, longer than the first period of time;

calculating a second total number representative of the total number of pulses occurring over the preceding third period of time; and determining that a no-flame condition exists if the second total number falls below the second threshold.

8. The method of claim 7 wherein the second threshold value is determined as a function of the first threshold value.

9. The method of claim 7 wherein the ratio between the first and second threshold values is substantially the same as the ratio between the first and third time periods.

10. The method of claim 3 further comprising the steps of:

defining a second threshold value;

defining a third period of time;

calculating a second total number representative of the total number of pulses received over the preceding third period of time; and determining that a no-flame condition exists if the second total number falls below the second threshold.

11. The method of claim 10 wherein the second period of time is N times the first period of time, where N is an integer.

12. The method of claim 11 wherein the step of calculating includes the steps of:

periodically storing, at times separated by a duration equal to the first time period, the most-recently-determined first total number;

adding the last (N-1) stored total numbers to provide a subtotal; and adding the present total number to the last subtotal to provide the second total number.

13. The method of claim 1 further comprising the step of:

detecting if no pulses have been received for a second selected period of time and providing a no-flame signal upon such detection of no pulses.

14. The method of claims 3, 4, 10, or 12 further comprising the step of:

detecting if no pulses have been received for a fourth selected period of time and providing a no-flame signal upon such detection of no pulses.

15. The method of claim 14 wherein the fourth selected period of time is equal to the second period of time.

16. A flame analyzer for providing a signal representative of the quality of a flame in a burner system of the type including a burner for producing a flame and a flame sensor responsive to the burner flame for producing signal pulses representative of the flame, the flame analyzer comprising:

means for defining a series of successively-occuring time intervals;

means for counting the number of pulses produced by the flame sensor during each interval;

a memory;

means, responsive to the counting means, for storing the number of pulses produced during each of a selected number of preceding intervals, the duration of said selected number of intervals defining a first period of time;

means for determining the number of pulses produced during the preceding first period of time to define a total number equal to the number of pulses produced during the preceding first period of time;

means for comparing said total number with a threshold value to determine when said total number is below the threshold value and for providing an output signal representative thereof which represents the flame quality.

17. The apparatus of claim 16 wherein the memory includes a plurality of registers, at least equal in number to said selected number;

and wherein the storing means includes means for storing data in each register representative of the number of pulses occurring during an associated interval such that data associated with the most recent interval is stored in the same register as and replaces the data associated with the oldest interval for which such data is stored in the registers.

18. The apparatus of claim 16 wherein the flame analyzer is further operative to provide a no-flame signal representative of an inadequate flame in the burner, and further comprises:

means for defining a second period of time; and means, responsive to the comparing means output signal, for providing a no-flame signal if said total number has continuously been below the threshold value for a period exceeding the second period of time.

19. The apparatus of claim 18 wherein the means for providing a no-flame signal further comprises:

means, responsive to the presence of a no-flame signal for continuing to provide a no-flame signal until said total number exceeds a pull-in value larger than the threshold value.

20. The apparatus of claim 19 including means for determining the pull-in value by multiplying the threshold value by a selected factor.

21. The apparatus of claim 20 wherein the selected factor is approximately 2.5.

22. The apparatus of claims 16, 17, or 21 further including:

means for defining a second threshold value;

means for defining a third period of time, longer than the first period of time;

means for calculating a second total number representative of the total number of pulses occurring over the preceding third period of time; and means for providing a no-flame signal if the second total number falls below the second threshold.

23. The apparatus of claim 22 including means, responsive to the first threshold value, for providing the second threshold value as a function of the first threshold value.

24. The apparatus of claim 22 wherein the relationship between the first and second threshold values is such that the ratio between the first and second threshold values is substantially the same as the ratio between the first and third time periods.

25. The apparatus of claim 18 further comprising:

means for defining a second threshold value;

means defining a third period of time;

means for calculating a second total number representative of the total number of pulses received over the preceding third period of time; and means for determining that a no-flame condition exists if the second total number falls below the second threshold.

26. The apparatus of claim 25 wherein the second period of time is N times the first period of time, where N is an integer.

27. The apparatus of claim 26 wherein the means for calculating includes:

means for periodically storing, at times separated by a duration equal to the first time period, the most-recently determined first total number and for determining the sum of the last (N-1) stored total numbers to provide a subtotal; and means for adding the present total number to the subtotal to provide the second total number.

28. The apparatus of claim 16 further comprising:

means for detecting if no pulses have been produced by the scanner for a second selected period of time and for providing a no-flame signal upon such detection of no pulses.

29. The apparatus of claims 18, 19, or 25 further comprising:

means for detecting if no pulses have been produced by the scanner for a fourth selected period of time and for providing a no-flame signal upon such detection of no pulses.

30. The apparatus of claims 16, 18, or 25 further comprising:

a flip-flop having a clock input, a data input, and an output;

means for applying to the data input of the flip-flop a periodic signal which alternates between high and low states;

means, responsive to no-flame signals, for providing a clock signal to the flip-flop only in the absence of a no-flame signal, said clock signal being so related to the periodic signal that the alternate high and low states thereof are clocked into, and appear at the output of, the flip-flop by said clock signal.

31. The apparatus of claim 16 wherein the means for counting comprises:

pulse means for providing an output pulse signal in response to a pulse applied thereto;

input means for selectively applying the pulses from the flame sensor to the pulse means;

counter means, responsive to the pulse means output signal, for providing a counter value which is representative of the number of pulses from the pulse means, which value is incremented in response to pulses from the input means; and means for periodically reading the value in the counter means to provide the number of pulses produced by the flame sensor during each interval.

32. The apparatus of claim 31 further comprising:

means, operative during a first test period, for providing a selected pattern of test pulses to the pulse means in place of the signal from the flame sensors; and means, operative during the first test period, for monitoring the counter value to determine the number by which the counter means is incremented in response to said selected pattern of test pulses, and for providing a malfunction signal in response to said counter means being incremented by other than a predetermined number.

33. The apparatus of claim 32 wherein the pulse means provides an output pulse of a fixed duration and is non-retriggerable during the duration of the output pulse;

wherein the predetermined pattern includes two test pulses occurring within a time less than said fixed duration of the pulse means output signal pulses; and wherein the monitoring means includes means for determining if the counter value is incremented by a value other than one in response to said two test pulses.

34. The flame analyzer of claims 16 or 32 wherein the burner system includes a shutter means which, when activated, shields the flame sensor from the burner flame, the flame analyzer further comprising:

means for periodically providing a sensor test period and for activating the shutter means during the sensor test period; and means, operative during the sensor test period, for determining if the counter value changes state and for providing an output signal representative of a malfunction in response to a change of state in the counter value during a predetermined consecutive number of sensor test periods.

35. The apparatus of claim 16 further comprising:

a reference terminal;

switch means for selecting the threshold value from among a plurality of possible threshold values including:

a plurality of contacts, and switch means for selectably connecting selected ones of the plurality of contacts to the reference terminal to select a threshold value;

means for periodically defining a test period;

means for applying a first signal level to the reference terminal during the test period and for applying a second signal level, different from the first signal level, to the reference terminal during non-test periods;

means, responsive to signals on the switch means contacts during non-test periods, for providing the threshold value;

means, responsive to signals on the switch means contacts during test periods, for detecting malfunctions of the switch means.

36. The apparatus of claim 16 further including an input circuit for providing signals to the flame analyzer for selecting a threshold value from among a plurality of threshold values, comprising:

a plurality of switch contacts, each contact being connected through an impedance to a first signal, the signals on the contacts being representative of the selected threshold value;

switch means for selectively connecting selected ones of the switch contacts to a common terminal;

means for periodically defining a test period;

means for applying a second signal, different from the first signal, to the common terminal during periods other than test periods and for disconnecting the second signal from the common terminal during test periods;

the correspondence between threshold values and signals on the switch contacts being such that for any combination of first and second signal levels on the switch contacts, any change of the signal level on a contact from the second signal level to the first signal level corresponds to an increase of the selected threshold value.

37. The apparatus of claim 36 further including:

means for applying the first signal to the common terminal during the test period;

means for applying the signal on each of the switch contacts to threshold inputs of the flame analyzer;

the flame analyzer further including means, operative during the test period, for detecting the application of a signal other than the first signal to the threshold inputs during the test period, and for providing a warning signal in response to any such detection.

* * * * *

UNITED STATES PATENT AND TRADEMARK OFFICE

CERTIFICATE OF CORRECTION

PATENT NO. : 4,280,184

DATED : July 21, 1981

INVENTOR(S) : Nathan K, Weiner et al.

It is certified that error appears in the above—identified patent and that said Letters Patent is hereby corrected as shown below:

Column 5, line 52, "mode" should read --model--.

Column 7, line 21, "change" should read --charge--.

Column 12, line 56, "3 5/8" should read --3 3/8--.

Signed and Sealed this

*Twenty-third* Day of *March 1982*

|SEAL|

*Attest:*

GERALD J. MOSSINGHOFF

*Attesting Officer*

*Commissioner of Patents and Trademarks*